United States Patent [19]

Weidler

[11] 4,295,009

[45] Oct. 13, 1981

[54] PIEZOELECTRIC AUDIO TRANSDUCER MOUNTING AND ELECTRICAL CONNECTOR

[75] Inventor: Charles H. Weidler, Lancaster, Pa.

[73] Assignee: AMP Incorporated, Harrisburg, Pa.

[21] Appl. No.: 128,331

[22] Filed: Mar. 7, 1980

[51] Int. Cl.[3] ..... H04R 17/00

[52] U.S. Cl. ..... 179/110 A; 179/179; 310/324; 310/348

[58] Field of Search ..... 179/103, 110 A, 178, 179/179; 310/324, 348

[56] References Cited

U.S. PATENT DOCUMENTS

| | | | |
|---|---|---|---|
| 3,214,722 | 10/1965 | Weimer, Jr. | 339/95 |
| 3,633,152 | 1/1972 | Podmore | 339/91 R |
| 4,124,785 | 11/1978 | Seretny et al. | 179/103 |

OTHER PUBLICATIONS

Molex-Technical Bulletin Introducing Molex's Audio Tone Transducer Sockets.

*Primary Examiner*—George G. Stellar
*Attorney, Agent, or Firm*—Frederick W. Raring

[57] ABSTRACT

A housing for a piezoelectric audio transducer comprises a molded cylindrical body having a transducer-receiving recess. Supporting surfaces are provided in the recess spaced from the inner end surface of the recess for supporting the transducer in spaced relationship to the inner end. Terminal receiving wells are provided in the inner end surface and a contact terminal is mounted in each well. A cantilever spring extends obliquely upwardly from each recess and has a contact portion which bears against a transducer supported on the supporting surfaces. Conductors extend from the terminals to the driving circuit for the transducer.

10 Claims, 8 Drawing Figures

PIEZOELECTRIC AUDIO TRANSDUCER MOUNTING AND ELECTRICAL CONNECTOR

FIELD OF THE INVENTION

This invention relates to mounting and contacting means for supporting and establishing electrical contact with a piezoelectric audio transducer.

BACKGROUND OF THE INVENTION

Widespread use is now being made of piezoelectric audio transducers which comprise generally of a thin sheet metal substrate having ceramic piezoelectric material on one surface thereof. Such transducers are frequently manufactured in the form of a flat relatively thin disc, common sizes having a diameter of about 27 millimeters and 35 millimeters. Transducers of this type are being used in telephone equipment, in smoke alarms, in electronic games, in warning devices on automobiles, and under many similar circumstances where a relatively small tone-generating device is required.

It is common practice to support, or mount, a disc-like audio transducer in a separate plastic housing which can be mounted on a circuit board containing the driving circuit or mounted adjacent to the circuit board. At least two, and sometimes three, wires must be connected to one surface of the transducer and this is commonly done by simply soldering the ends of the wires to the appropriate locations on the transducer. These soldered connections are not entirely satisfactory from a performance standpoint and they are objectionable from a manufacturing standpoint. Since the wires must be soldered to predetermined locations on the transducer, the soldering operation must be carried out by hand, a time-consuming and expensive procedure. Furthermore, the heat of the soldering iron may damage the transducer and the surface to which the wires are soldered must be rendered receptive to the solder and this may require some special treatment, such as tin plating the surface and providing a suitable solder flux thereon.

It has been recognized in the past that it would be desirable to use stamped and formed contact terminals for establishing contact with piezoelectric transducers, since terminals can be produced at relatively low cost, can be connected to wires which extend to the driving circuit by automatic crimping machines, and are generally preferable to hand soldering as a means of establishing electrical contact. However, the service requirements of contact terminals used for transducers present several problems which are not encountered under ordinary circumstances in which contact terminals are used. For example, when a transducer is energized or driven, it vibrates at a frequency of 3,000 cps or more, and a spring contact which is in engagement with the transducer will therefore be flexed at the same frequency. Repeating flexure of a spring contact at this frequency may cause fatigue failures in most commonly used spring contacts, for example, spring contacts of the types used in switches, for the reason that such contacts are designed for use under static conditions with only occasional flexing. Furthermore, contacts which would be used for a piezoelectric device would necessarily be relatively small (as noted above, a commonly used transducer has a diameter of only 27 mm) and the spring arms or spring members of such a contact would necessarily be relatively short. The short, relatively stiff spring would be highly susceptible to fatigue failure when flexed at a frequency of 3,000 cps. A further consideration is that the terminals for an inexpensive transducer assembly would, of necessity, be produced with a minimum amount of relatively inexpensive spring material, such as a spring hard brass, rather than a relatively high priced material which would be resistant to fatigue failure.

The present invention is directed to the achievement of a transducer housing assembly containing contact terminals arranged in the housing such that the transducer disc is contacted by the terminals when the transducer is assembled to the housing. The invention is further directed to the achievement of an assembly which will contain terminals that are resistant to fatigue failure and which will last for the useful life of the device in which the transducer is used.

The transducer housing assembly, in accordance with the invention, comprises generally a molded insulating housing having a recess therein in which there are provided supporting surfaces for supporting the transducer in spaced relationship to the inner end of the recess. Two, or sometimes three, contact terminals are mounting in terminal-receiving wells which extend into the inner end surface of the recess beneath the transducer. Each terminal has a body portion which is retained in the well and a cantilever spring extending at an acute angle from the body portion of the terminal. The spring of each terminal extends obliquely towards the transducer and has a contact portion which is resiliently biased against, and in engagement with, the surface of the transducer. The arrangement is such that the housing diameter is only slightly greater than the diameter of the transducer and the thickness of the housing is well within reasonable limits with regard to the size of the transducer and the circumstances (use in hand-held games or the like) under which it is used. By virtue of the fact that the contact springs extend at a relatively small acute angle from the body portions of the terminals, the fatigue resistance of the individual spring is very good and the contacts are capable of use without failure during the expected life of the transducer.

DRAWINGS

PRACTICE OF THE INVENTION

Figure 1:
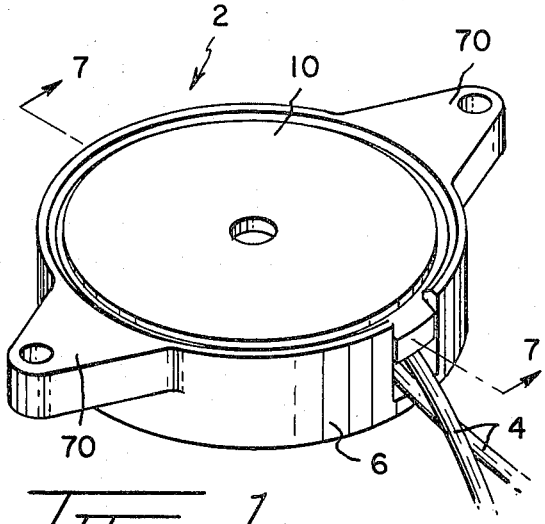
FIG. 1 is a perspective view of a transducer assembly in accordance with the invention.
Figure 2:
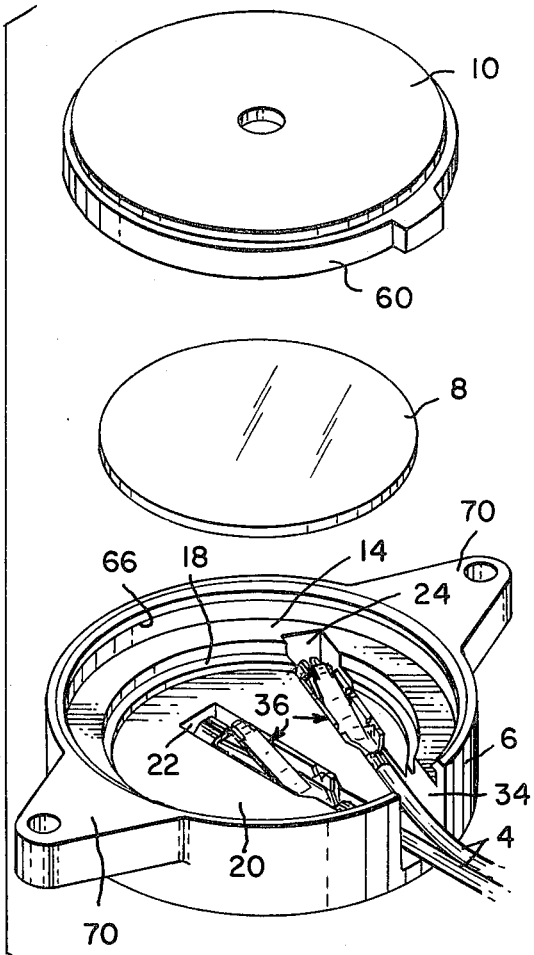
FIG. 2 is an exploded view showing the parts of the assembly in FIG. 1.
Figure 3:
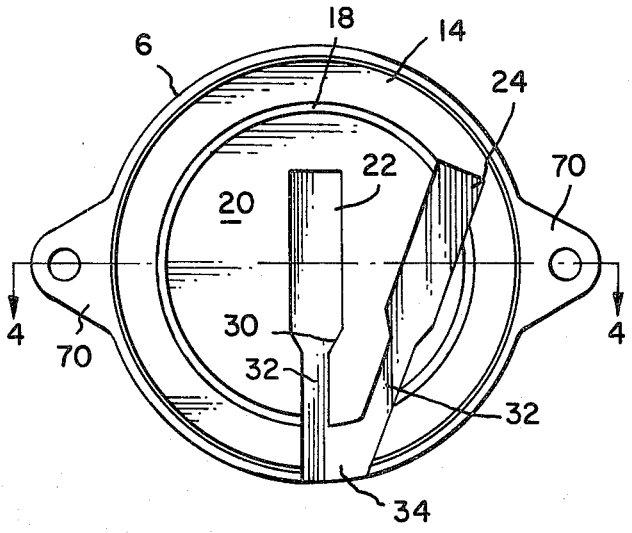
FIG. 3 is a plan view of the housing body portion of the assembly.
Figure 4:
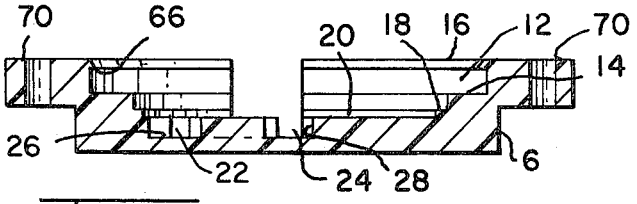
FIG. 4 is a cross-sectional view taken along the lines 4—4 of FIG. 3.
Figure 7:
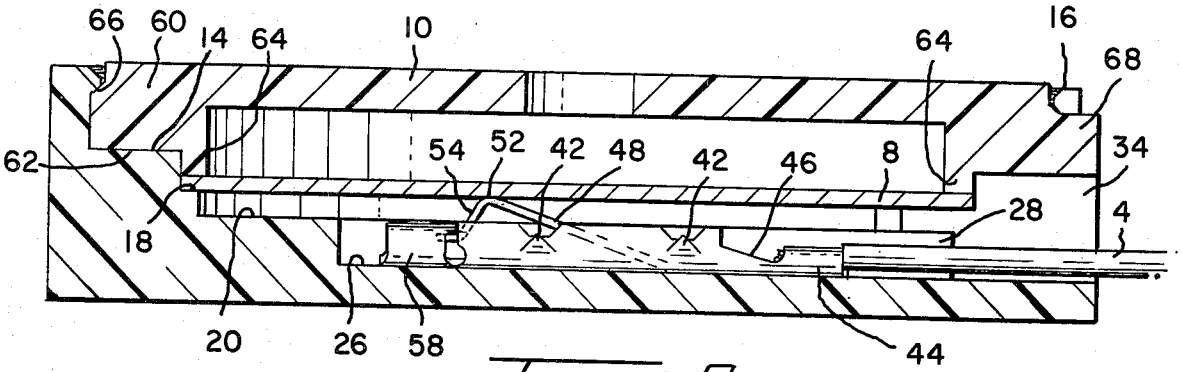
FIG. 7 is a cross-sectional view taken along the lines 7—7 of FIG. 1.

A transducer assembly, in accordance with the invention, comprises a housing assembly 2, as shown in FIGS. 1-4, having wires 4 extending therefrom which are connected to the driving circuit for the transducer contained in the housing. The housing assembly comprises a cylindrical housing body 6 and a housing cover 10, the body 6 having a cylindrical recess 12 extending inwardly from its upper end 16 which is dimensioned to receive the piezoelectric audio transducer device 8. A first circumferential ledge 14 is provided in the recess 16 and an inner slightly lower ledge 18 is provided having a diameter which conforms to the diameter of the transducer 8 so that the transducer can be supported on the ledge 18, as shown in FIG. 7. The ledge 18 is located above the inner surface 20 of the recess 12 and a pair of terminal-receiving wells 22, 24 extend inwardly from the inner surface 20. The wells are identical to each other so that a description of one will suffice for both. These wells are dimensioned to receive a terminal 36, as described below, and each well has a floor 26 which is below the inner surface 20 of the recess, the wells having well sidewalls 28 which extend vertically from the surface 20 to the floors 26. As shown in FIG. 3, the terminal-receiving well 22 is located substantially on a diameter of the housing body 6, while the well 24 extends along a chordal line with respect to the body 6. Each well has a transition section 30 which communicates with a relatively narrow wire-receiving channel 32. The channels, in turn, merge with each other and extend to an opening 34 in the side surface of the housing body.

Figure 5:
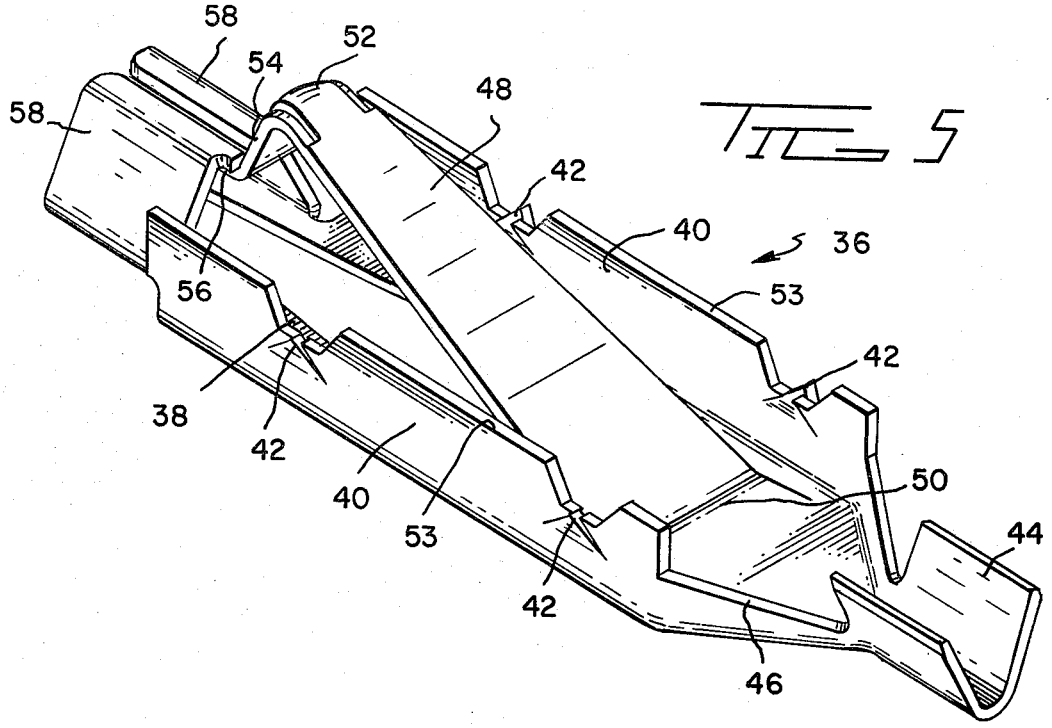
FIG. 5 is a perspective view of the contact terminal of the type used in the practice of the invention.
Figure 6:
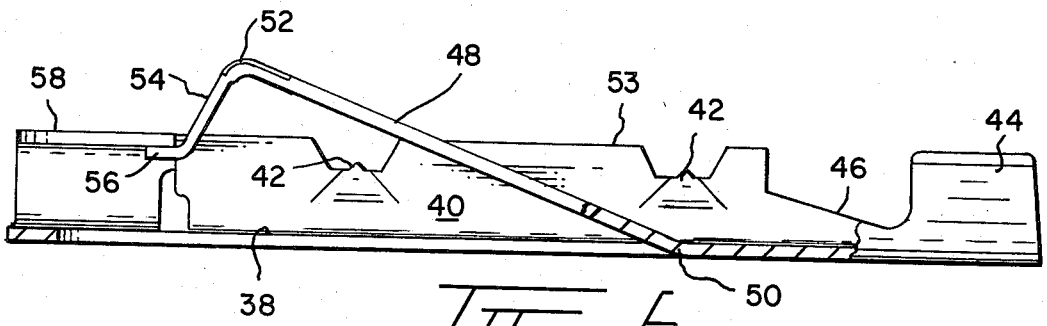
FIG. 6 is a plan view of the terminal of FIG. 5.

As shown in FIGS. 5 and 6 the terminals 36 which are contained in the wells 22, 24 are of stamped and formed sheet metal having a body portion which has a generally channel-shaped cross section consisting of a flat web 38 and parallel sidewalls 40. Barbs 42 are struck outwardly from the sidewalls and the width of the body portion is substantially equal to the width of the well 22 so that the terminal can be pushed downwardly into the well and will have an interference fit with the sidewalls of the well. The body portion of each terminal merges with a transition section 46 which conforms to the transition sections 30 of the well and these transition sections 46, in turn, merge with a crimped portion 4 by means of which the terminals are connected to the wires 4.

Each terminal has a cantilever spring 48 struck from its web portion 38, this spring having a fixed end 50 which is adjacent to the transition section 46 and a free end 56 which is adjacent to the forward end of the terminal. The spring 48 extends obliquely upwardly at a minor acute angle with reference to the plane of the web and is reversely bent, as shown at 52, to define a contact portion which engages the transducer. The end portion 54 of the spring extends downwardly towards the web and the free end 56 is bent laterally and extends forwardly. The sidewalls 40 are formed inwardly, as shwon at 58, at the forward end of the terminal and the free end 56 of the spring is captured beneath these inwardly formed sidewall sections 58. This arrangement protects the spring members 48 of the terminals from damage during manufacture, handling, and assembly of the terminals to the housing. It will be noted that the contact portion 52 of the terminal spring is substantially above the upper edges 53 of the sidewalls 40. By virtue of this relationship, the contact portions of the springs will be preloaded against the transducer when the transducer is mounted in the housing body.

As shown in FIGS. 1, 2 and 7 the cover member 10 comprises a disc having a relatively thick rim portion 60, the downwardly facing surface 62 of which bears against the ledge 14 of the housing body when the cover is assembled to the body. A circumferential flange 64 extends downwardly from the enlarged rim 60 and is located such that it will be opposed to the ledge 18 when the cover is assembled to the housing body. The transducer will therefore be clamped around its periphery by the flange 64 when the transducer and the cover are assembled to the housing body 6. The cover is maintained in assembled relationship to the body by an inwardly directed circumferential lip 66 in the recess 12 adjacent to the upper end 16 of the body. Mounting ears 70 may be provided on the body for securing it to a panel or the like.

The assembly of the housing and the transducer merely requires that the terminals be located above the wells 22, 24 and pushed downwardly until they are completely inserted into the wells. Advantageously, the terminals are dimensioned such that the upper edges 53 of the terminal sidewalls will be on the same level as, or slightly below, the inner end surface 20 of the recess when the terminals are properly positioned. After mounting of the terminals in the housing body, the contact springs 48 will extend above the ledge 18 so that the contact portions 52 of the springs will be above the plane of the ledge 18. The transducer is then assembled to the housing body by merely positioning it in the recess with its periphery supported on the ledge 18. The cover is then assembled to the housing body to retain the transducer therein with its periphery clamped between the ledge 18 and the flange 64. The contact springs 48 will be flexed downwardly when the cover is assembled to the housing body and the contact portions will therefore be preloaded against the transducer in the completed assembly, as shown in FIG. 7.

Transducer housings and terminals, in accordance with the invention, can be made to conform to the standard sizes of transducers being used. As mentioned above, one widely used type of transducer has a diameter of 27 millimeters and a housing for this size transducer will have an overall diameter of about 37 millimeters. The terminals for a housing of this size can be produced from brass strip having a thickness of 0.20 mm, the terminals having an overall length of about 18 mm.

Terminals in accordance with the invention have been found to have extremely long life and are highly resistant to fatigue failures notwithstanding the arduous conditions of service in which they are used. One feature which contributes substantially to the fatigue failure resistance of the spring arm of the terminal is the fact that the spring arm 48 extends at a relatively minor acute angle from the plane of the web portion 38 of the terminal. This spring arm is formed by shearing a portion of the web material and forming it upwardly from the web to produce the final form shown in FIGS. 5 and 6. The fact that the spring arm is bent out of the plane of the web through only a small angle, about 22 degrees, minimizes the cold-working of the web at the inner, or fixed, end 50 of the spring arm. Minimization of the amount of cold-working in this zone, in turn, results in a relatively undisturbed metallographic structure (rather than a highly cold-worked structure) which is fatigue resistant. The fatigue resistance of the spring arm is also enhanced by virtue of the fact that the spring is of decreasing width, as shown in FIG. 5, from its fixed end 50 to its contact portion 52. This tapered configuration reduces the stress level at the fixed end when the spring is flexed, thereby increasing the fatigue life of the spring. Connector assemblies, in accordance with the invention have, in fact, been life tested for a period of 200 hours, that is, the transducer has been driven for 200 hours without failure of the springs.

Figure 8:
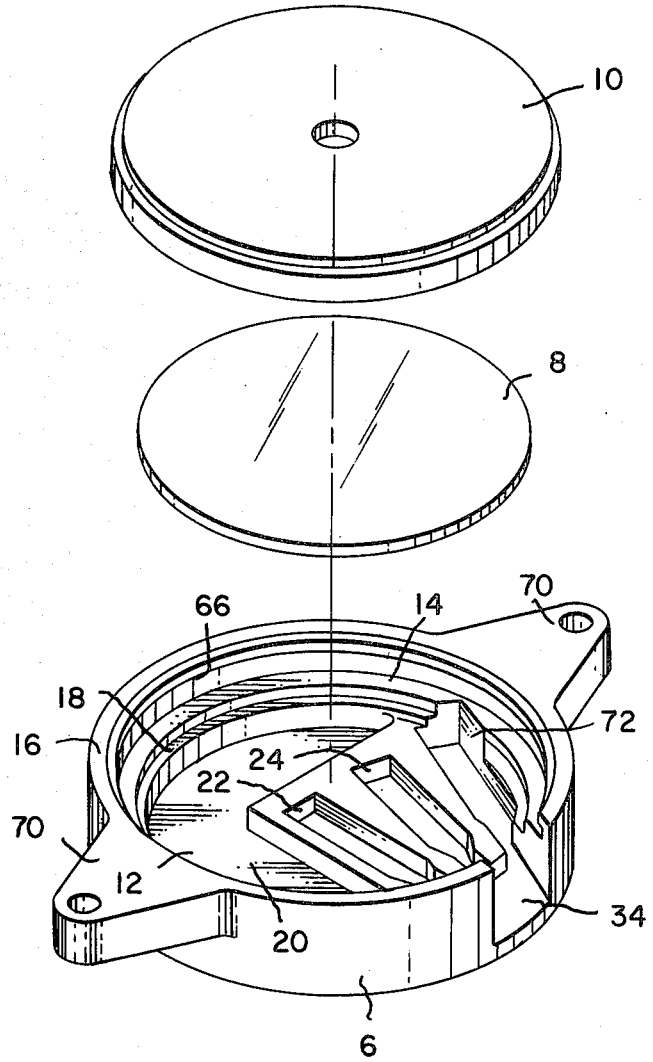
FIG. 8 is a perspective view of a housing body in accordance with an alternative embodiment.

As shown in FIG. 3, the terminal positioned in the well 22 will engage the transducer at a location adjacent to the geometric center thereof and the terminal positioned in the well 24 will contact the transducer adjacent to its outer edge. Under some circumstances, it is desirable to provide three terminals which contact the transducer at three locations, one near the center of the transducer, one adjacent to the edge thereof, and one at an intermediate location. FIG. 8 shows an embodiment having a third well 72 in which a third terminal is positioned for contacting the transducer at this intermediate location.

As an alternative to providing a separate housing for the transducer, it is desirable under some circumstances to form the transducer housing in one of the internal walls of a housing or cover of the device with which the transducer is being used. For example, the housing for a hand held game, or a telephone instrument cover, may be provided on their internal surfaces with a transducer housing in accordance with the principles of the present invention.

I claim

1. Supporting and contacting means for a piezoelectric audio transducer comprising:

transducer housing means having a transducer-receiving recess therein which is dimensioned to receive said transducer, said recess having an inner end surface and having transducer-supporting surface portions for supporting peripheral portions of said transducer, said transducer supporting surface portions being spaced from said inner end surface, first and second terminal-receiving wells in said inner end surface, each of said wells having a terminal-supporting floor and having sidewalls extending from said inner end surface to said terminal-supporting floor, first and second contact terminal in said wells, each of said terminals having an elongated generally channel-shaped frame section comprising a web and terminal sidewalls extending from said web, said web being on said floor and said terminal sidewalls being against said well sidewalls, an elongated spring struck from said web along the length thereof, said spring extending obliquely from said web at an acute angle and having a contact portion which is normally elevated above said inner end surface and above said transducer supporting surface portions, conductor means extending from said web at each end thereof and externally of said housing means and clamping means for clamping said transducer in said recess with peripheral portions thereof on said transducer supporting surfaces whereby, upon placement of said transducer in said recess, and clamping said transducer against said transducer supporting surface portions, said contact springs are flexed towards said webs of said terminals and are thereby placed in preloaded resilient contact with said transducer.

2. Supporting and contacting means as set forth in claim 1, said recess being circular and being intended for a circular transducer, said first terminal-receiving well extending substantially diametrically across said inner end surface whereby said contact portion of said first terminal will contact said transducer adjacent to the center thereof, said second terminal-receiving well extending as a chord across said inner end surface whereby said contact portion of said second terminal will contact said transducer adjacent to the periphery thereof, conductor-receiving channels extending partially across said inner end surface from corresponding ends of said wells, said channels merging with each other and extending to one side of said housing means.

3. Supporting and contacting means as set forth in claim 1, said transducer housing means comprising a housing body and a housing cover, said transducer-receiving recess being in said body, said clamping means being on said cover.

4. Supporting and contacting means as set forth in claim 1, said conductor means extending from said web of each of said contact terminals comprising wires connected to said terminals by crimped connections.

5. Supporting and contacting means as set forth in claim 1 having retaining means serving to retain said contact terminals in said terminal-receiving wells.

6. Supporting and contacting means as set forth in claim 5, said retaining means comprising retaining barbs on said terminal sidewalls, said barbs being in engagement with said sidewalls of said terminal-receiving wells.

7. Supporting and contacting means as set forth in claim 1, said elongated spring of each of said terminals comprising a cantilever spring, said spring having a free end, said contact portion being adjacent to said free end.

8. Supporting and contacting means as set forth in claim 7, said cantilever spring being reversely bent at said contact portion and having an end portion which extends from said contact portion towards said web and to said free end.

9. Supporting and contacting means as set forth in claim 8, one end of said terminal being proximate to said free end of said spring, said sidewalls of said terminal having inwardly formed portions at said one end, said free end of said spring being captured between said inwardly formed portions and said web.

10. Supporting and contacting means as set forth in either of claims 7 or 9, said cantilever spring being of decreasing width along its length from said web to said contact portion.

* * * * *